US006851474B2

(12) United States Patent
Nguyen

(10) Patent No.: US 6,851,474 B2
(45) Date of Patent: Feb. 8, 2005

(54) METHODS OF PREVENTING GRAVEL LOSS IN THROUGH-TUBING VENT-SCREEN WELL COMPLETIONS

(75) Inventor: Philip D. Nguyen, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 78 days.

(21) Appl. No.: 10/360,949

(22) Filed: Feb. 6, 2003

(65) Prior Publication Data

US 2004/0154796 A1 Aug. 12, 2004

(51) Int. Cl.[7] ..... E21B 43/02
(52) U.S. Cl. ..... 166/276; 166/278
(58) Field of Search ..... 166/276, 278, 166/51

(56) References Cited

U.S. PATENT DOCUMENTS

| | | | | | |
|---|---|---|---|---|---|
| 4,000,781 | A | | 1/1977 | Knapp | 166/276 |
| 4,042,031 | A | | 8/1977 | Knapp | 166/276 |
| 4,074,760 | A | * | 2/1978 | Copeland et al. | 166/276 |
| 4,216,829 | A | | 8/1980 | Murphey | 166/276 |
| 4,368,136 | A | | 1/1983 | Murphey | 252/316 |
| 4,942,186 | A | | 7/1990 | Murphey et al. | 523/131 |
| 5,033,549 | A | | 7/1991 | Champeaux et al. | 166/278 |
| 5,128,390 | A | | 7/1992 | Murphey et al. | 523/130 |
| 5,333,688 | A | | 8/1994 | Jones et al. | 166/278 |
| 5,420,174 | A | | 5/1995 | Dewprashad | 523/130 |
| 5,609,207 | A | * | 3/1997 | Dewprashad et al. | 166/276 |
| 5,755,286 | A | | 5/1998 | Ebinger | 166/281 |
| 6,079,492 | A | * | 6/2000 | Hoogteijling et al. | 166/276 |
| 6,439,309 | B1 | | 8/2002 | Matherly et al. | 166/276 |
| 6,729,404 | B2 | * | 5/2004 | Nguyen et al. | 166/280.2 |
| 2002/0062960 | A1 | | 5/2002 | George et al. | 166/278 |

FOREIGN PATENT DOCUMENTS

| | | | |
|---|---|---|---|
| EP | 0497055 | 12/1991 | E21B/43/02 |
| EP | 0718464 | 12/1994 | E21B/43/25 |

* cited by examiner

*Primary Examiner*—David Bagnell
*Assistant Examiner*—Elton McWilliams
(74) *Attorney, Agent, or Firm*—Robert A. Kent; C. Clark Dougherty, Jr.

(57) ABSTRACT

Methods of forming through-tubing vent-screen tool completions in a well bore containing a producing zone are provided. The methods basically comprise placing the through-tubing vent-screen tool in the well bore adjacent to the producing zone, coating gravel to be placed in the well bore with a hardenable resin composition, combining the hardenable resin composition coated gravel with an aqueous carrier liquid, pumping the aqueous carrier liquid containing the coated gravel into the well bore between the producing zone and the tool to place hardenable resin composition gravel therein and allowing the hardenable resin composition to harden.

34 Claims, 2 Drawing Sheets

METHODS OF PREVENTING GRAVEL LOSS IN THROUGH-TUBING VENT-SCREEN WELL COMPLETIONS

BACKGROUND OF THE INVENTION

1. Field of the Invention

The present invention relates to methods of forming through-tubing vent-screen tool completions in a well bore whereby gravel lost from between the tool and the well bore is prevented.

2. Description of the Prior Art

Through-tubing vent-screen completions have heretofore been utilized in well bores containing casing and perforations through the casing and cement into a producing zone. The through-tubing vent-screen tool utilized includes three basic components, i.e., a primary screen connected to a blank spacer pipe which is in turn connected to a vent-screen. The primary screen section of the tool is positioned adjacent to the perforated interval and an unconsolidated gravel pack is placed between the vent-screen and all or a portion of the blank spacer pipe. The hydrocarbons produced from the producing zone flow through the gravel pack, into the primary screen, through the blank spacer pipe and out through the vent-screen. The hydrocarbons then flow through the casing or production tubing to the surface.

The gravel, e.g., graded sand, has heretofore not been consolidated into a hard permeable mass by a hardenable resin composition coated on the gravel. The reason for this has been that the consolidated gravel pack does not have compressive forces exerted on it, and consequently, a hardenable resin composition coated on the gravel cannot consolidate the gravel. That is, because the gravel particles are not packed together under compressive forces, the particles in the pack do not contact each other with sufficient force for the pack to be consolidated into a hard permeable pack.

The function of the gravel pack is to prevent formation sand and fines from flowing out of the producing zone with produced hydrocarbons. Heretofore, the unconsolidated gravel has been placed in the well bore around the vent-screen and around the blank spacer pipe whereby the gravel pack has sufficient height to maintain the stability of the gravel pack while the well is producing hydrocarbons. The gravel pack around the blank spacer pipe prevents formation sand and fines from flowing out of the producing zone with produced hydrocarbons. However, if the blank spacer pipe and the height of the gravel pack are too short, the gravel pack will become unstable as the gravel fluidizes whereby a portion of the hydrocarbons flow through the gravel pack and formation sand and fines are produced with the hydrocarbons. More often, the produced hydrocarbons by-pass the through-tubing vent-screen tool, fluidizing the gravel and carrying it and formation sand and fines to the surface.

There is often a limited space between the primary screen and the top vent-screen in the well bore. As a result, it would be desirable to be able to utilize a short blank pipe and gravel pack that separate the two screens.

While sticky tackifying agents have heretofore been coated on the gravel for the purpose of increasing the cohesiveness between the gravel particles and thus increasing the gravel pack resistance to fluidization, the gravel pack has still become fluidized when it is exposed to high production flow rates whereby it flows out of the well bore with produced fluids and formation sand and fines are carried to the surface.

Thus, there are needs for an improved through-tubing vent-screen completion whereby the gravel pack is consolidated into a hard permeable pack which is short, will not fluidize and is capable of continuously preventing the production of formation sand and fines with produced hydrocarbons.

SUMMARY OF THE INVENTION

The present invention provides improved methods of forming through-tubing vent-screen tool completions which meet the needs described above and overcome the deficiencies of the prior art. In accordance with the methods, the gravel utilized to form the gravel pack in the well bore is coated with a resin composition which consolidates the gravel into a hard permeable pack without compressive forces being exerted on the gravel pack. As a result, the gravel pack will not become fluidized at normal production rates and also allows the lengths of the blank spacer pipe and the gravel pack to be much shorter than those utilized heretofore.

The methods of the present invention for forming a through-tubing vent-screen tool completion in a well bore adjacent to a producing zone is comprised of the following steps. A through-tubing vent-screen tool is placed in the well bore adjacent to the producing zone therein. The gravel to be placed in the well bore is coated with a hardenable resin composition comprised of a hardenable resin, a hardening agent for causing the hardenable resin to harden, a silane coupling agent, a surfactant for facilitating the coating of the hardenable resin composition on the gravel and for causing the hardenable resin composition to flow to the contact points between adjacent resin coated gravel particles and an organic carrier liquid having a flash point above about 125° F. The hardenable resin composition coated gravel is combined with an aqueous carrier liquid. The aqueous carrier liquid containing the hardenable resin composition coated gravel is pumped into the well bore between the producing zone therein and the tool to place the hardenable resin composition gravel therein. Thereafter, the hardenable resin composition on the coated gravel is allowed to harden and consolidate the gravel into a high strength permeable gravel pack which prevents the loss of the gravel with produced fluids.

The objects, features and advantages of the present invention will be readily apparent to those skilled in the art upon a reading of the description of preferred embodiments which follows when taken in conjunction with the accompanying drawings.

DESCRIPTION OF PREFERRED EMBODIMENTS

In accordance with the methods of the present invention through-tubing vent-screen tool completions are formed in well bores adjacent to producing zones which include consolidated, high strength permeable gravel packs that prevent the migration of formation sand and fines with produced hydrocarbons and prevent the loss of the gravel. A method of the present invention for forming a through-tubing vent-screen tool completion in a well bore adjacent to a producing zone is basically comprised of the following steps. A through-tubing vent-screen toot is placed in the well bore adjacent to a producing zone therein. Gravel to be placed in the well bore is coated with a hardenable resin composition comprised of a hardenable resin, a hardening agent for causing the hardenable resin to harden, a silane coupling agent, a surfactant for facilitating the coating of the hardenable resin composition on the gravel and for causing the hardenable resin composition to flow to the contact points between adjacent resin coated gravel particles and an organic carrier liquid having a flash point above about 125° F. The hardenable resin composition coated gravel is combined with an aqueous carrier liquid. The aqueous carrier liquid containing the hardenable resin composition coated gravel is pumped into the well bore between the producing zone therein and the through-tubing vent-screen tool to place the hardenable resin composition gravel therein. Thereafter, the hardenable resin composition on the coated gravel is allowed to harden and consolidate the gravel into a high strength permeable gravel pack which prevents the migration of formation sand and fines with formation fluids and prevents the loss of gravel with the fluids.

Figure 1:
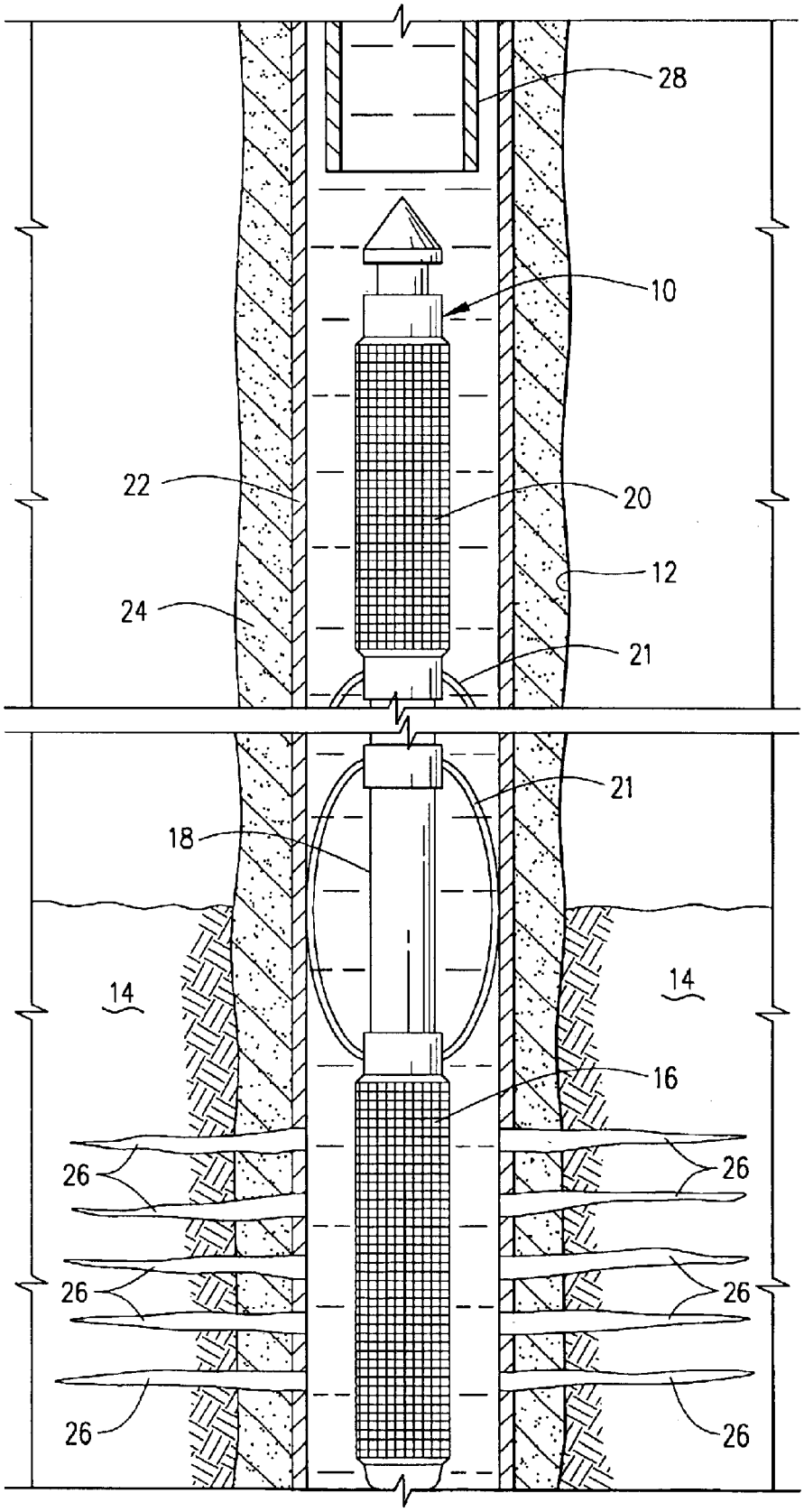
FIG. 1 is a side cross-sectional view of a cased, cemented and perforated well bore having a through-tubing vent-screen tool and a production string disposed therein.

Referring to the drawings and particularly to FIG. 1, a through-tubing vent-screen tool designated by the numeral 10 is illustrated after it has been placed in a well bore 12 penetrating a subterranean producing zone 14. The tool 10 includes a primary inlet screen 16, a blank spacer pipe 18 and a vent-screen 20. The tool 10 also includes two or more bow spring centralizers 21 for centralizing the tool 10 within the casing 22. The well bore 12 includes a casing 22, cement 24 which seals the casing 22 in the well bore 12 and a plurality of perforations 26 extending through the casing 22, the set cement 24 and into the producing formation 14. A production string 28 is disposed within the casing 22 above the tool 10.

Figure 2:
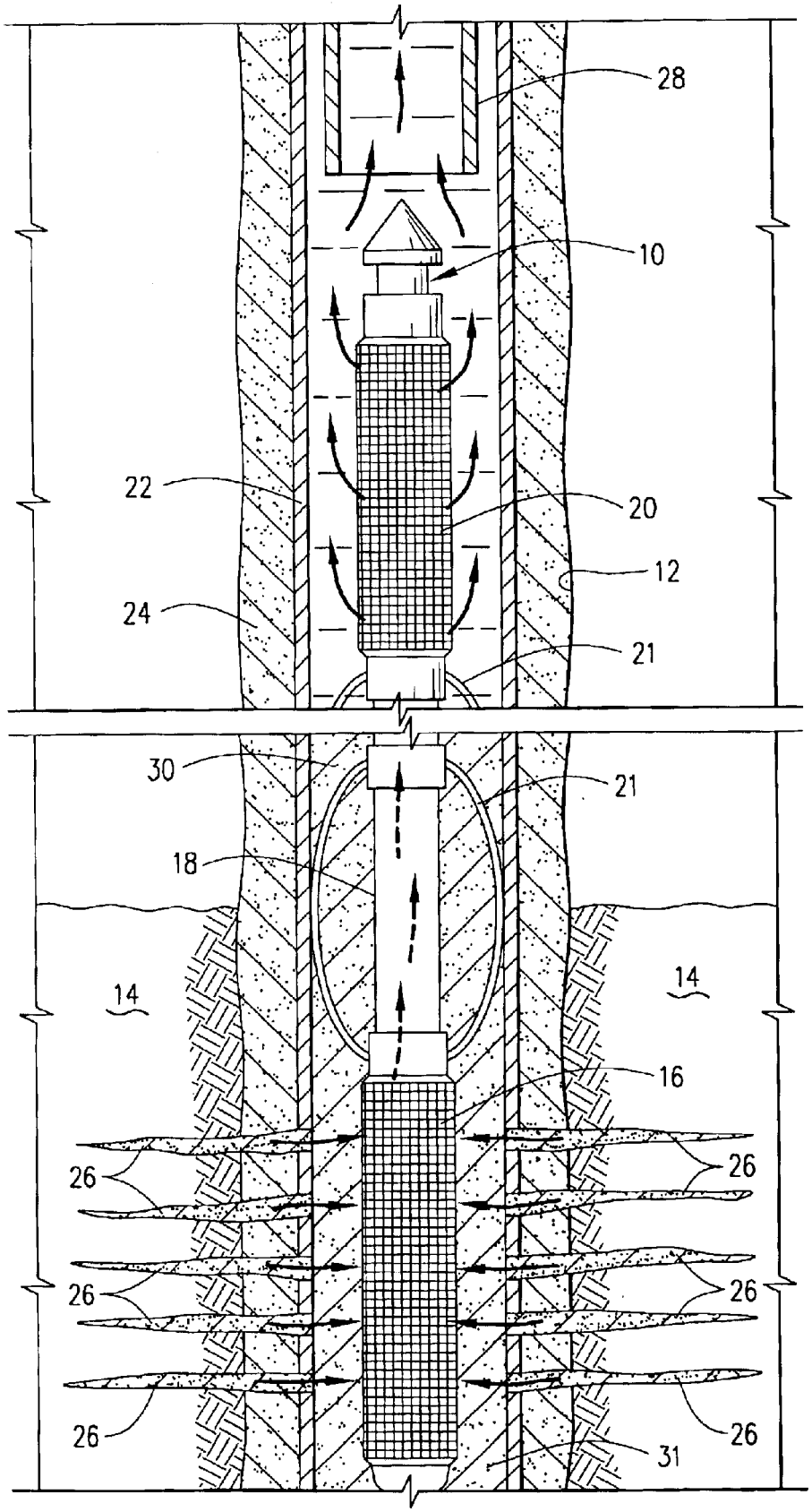
FIG. 2 is a cross-sectional view of the cased, cemented and perforated well bore having a through-tubing vent-screen tool therein and a consolidated, high strength, permeable gravel pack formed around the tool.

Referring now to FIG. 2, the tool 10, the well bore 12, the producing zone 14, the casing 22, the set cement 24, the perforations 26 and a consolidated high strength permeable gravel pack 30 disposed around the primary screen 16 and a portion of the blank spacer pipe 18 are shown. As also shown by arrows in FIG. 2, hydrocarbons from the producing zone 14 flow through the perforations 26, through the consolidated high strength permeable gravel pack 30 and into the interior of the primary screen 16. The hydrocarbons flow within the blank spacer pipe to the vent screen 20 wherein they exit into the interior of the casing 22 and flow to the surface by way of the production tubing 28.

The production zone can also simply be an open hole interval that does not contain casing, cement and perforations.

Examples of hardenable resins which can be utilized in the above mentioned hardenable resin composition include, but are not limited to, bisphenol A-epichlorohydrin resin, polyepoxide resin, novolak resin, polyester resin, phenol-aldehyde resin, urea-aldehyde resin, furan resin, urethane resin, glycidyl ether and mixtures thereof. Of these, bisphenol A-epichlorohydrin resin is presently preferred. The hardenable resin utilized is included in the hardenable resin composition in an amount in the range of from about 35% to about 60% by weight of the composition, preferably in an amount of about 45%.

Examples of hardening agents which can be utilized in the hardenable resin composition include, but are not limited to, amines, aromatic amines, polyamines, aliphatic amines, cyclo-aliphatic amines, amides, polyamides, 4,4'-diamino-diphenylsulfone, 2-ethyl-4-methylimidaole and 1,1,3-trichlorotrifluoroacetone. Of these, 4,4'-diaminodiphenylsulfone is presently preferred. The hardening agent utilized is present in the hardenable resin composition in an amount in the range of from about 35% to about 50% by weight of the composition, preferably in an amount of about 40%.

Examples of silane coupling agents which can be utilized in the hardenable resin composition include, but are not limited to, at least one member selected from the group consisting of N-2-(aminoethyl)-3-aminopropyltrimethoxysilane, 3-glycidoxypropyl-trimethoxysilane and n-beta-(aminoethyl)-gamma-aminopropyltrimethoxysilane. Of these, n-beta-(aminoethyl)-gamma-aminopropyltrimethoxysilane is presently preferred. The silane coupling agent is present in the hardenable resin composition in an amount in the range of from about 0.1% to about 5% by weight of the composition, preferably in an amount of about 1%.

Examples of surfactants which facilitate the coating of the resin on the gravel particles and cause the hardenable resin to flow to the contact points between adjacent proppant particles include, but are not limited to, an ethoxylated nonylphenol phosphate ester, mixtures of one or more cationic surfactants and one or more non-ionic surfactants and a $C_{12}$–$C_{22}$ alkyl phosphonate surfactant. The mixtures of one or more cationic and nonionic surfactants that can be utilized are described in U.S. Pat. No. 6,311,733 issued to Todd et al. on Nov. 6, 2001 which is incorporated herein by reference thereto. Of the various surfactants which can be utilized, a $C_{12}$–$C_{22}$ alkyl phosphonate surfactant is presently preferred. The surfactant utilized in the hardenable resin composition is present therein in an amount in the range of from about 0.1% to about 10% by weight of the composition, preferably in an amount of about 5%.

Examples of organic carrier liquids which have flash points above about 125° and can be utilized in the hardenable resin compositions of this invention include, but are not limited to, dipropylene glycol methyl ether, dipropylene glycol dimethyl ether, dimethyl formamide, diethylene glycol methyl ether, ethylene glycol butyl ether, diethylene glycol butyl either, propylene carbonate, d'limonene and fatty acid methyl esters. Of these, dipropylene glycol methyl ether is presently preferred. The organic carrier liquid utilized in the hardenable resin composition is present in an amount up to about 20% by weight of the composition, preferably in an amount of about 9%.

The aqueous carrier liquid in which the hardenable resin composition coated gravel is combined for carrying the hardenable resin composition coated gravel into the well bore and placing it between the producing zone and the through-tubing vent-screen tool can be fresh water or salt water. The term "salt water" is used herein to mean unsaturated salt solutions and saturated salt solutions including brine and seawater.

The hardenable resin composition utilized in accordance with this invention can be stored for long periods of time without deterioration when the hardening agent is kept separate from the mixture of the other components in the composition. The hardening agent can be combined with a small portion of the organic carrier liquid having a flash point above about 125° F. After storage, the components can be mixed in a weight ratio of about one part liquid hardenable resin component to about one part liquid hardening agent component just prior to being coated onto the gravel particles. The mixing of the components can be by batch mixing or the two components can be metered through a static mixer to obtain a homogenous mixture before coating the mixture directly onto dry gravel particles. The coating of the gravel particles with the hardenable resin composition can be accomplished in a variety of ways known to those skilled in the art. A particularly suitable technique for coating the gravel particles with the hardenable resin composition is to spray the hardenable resin composition on the gravel particles as they are conveyed in a sand screw. The amount of the hardenable resin composition coated on the gravel particles can range from about 0.1% to about 5% by weight of the gravel particles, preferably in an amount of about 3%.

The gravel particles utilized in accordance with the present invention are generally of a size such that formation sand and fines which migrate with produced fluids are prevented from flowing through the consolidated high strength permeable gravel pack formed when the hardenable resin composition hardens. Various kinds of gravel can be utilized including graded sand, bauxite, ceramic materials, glass materials, walnut hulls, and polymer beads. The preferred proppant is graded sand having a particle size in the range of from about 10 to about 70 mesh U.S. Sieve Series. Preferred sand particle size distribution ranges which can be utilized include one or more of 10–20 mesh, 20–40 mesh, 40–60 mesh or 50–70 mesh, depending on the particular size and distribution of formation solids to be screened out by the consolidated gravel particles.

A preferred method of forming a through-tubing vent-screen tool completion in a well bore adjacent to a producing zone is comprised of the steps of: (a) placing the through-tubing vent-screen tool in the well bore adjacent to the producing zone therein; (b) coating gravel to be placed in the well bore with a hardenable resin composition comprised of a hardenable resin, a hardening agent for causing the hardenable resin to harden, a silane coupling agent, a surfactant for facilitating the coating of the hardenable resin composition on the gravel and for causing the hardenable resin composition to flow to the contact points between adjacent resin coated gravel particles, and an organic carrier liquid having a flash point above about 125° F.; (c) combining the hardenable resin composition coated gravel produced in step (b) with an aqueous carrier liquid; (d) pumping the aqueous carrier liquid containing the hardenable resin composition coated gravel into the well bore between the producing zone therein and the tool to place the hardenable resin composition gravel therein; and (e) allowing the hardenable resin composition on the coated gravel to harden and consolidate the gravel into a high strength permeable gravel pack which prevents the loss of gravel with produced fluids.

Another preferred method of forming a through-tubing vent-screen tool completion in a well bore adjacent to a producing zone comprises the steps of: placing the through-tubing vent-screen tool in the well bore adjacent to the producing zone therein; coating gravel to be placed in the well bore with a hardenable resin composition comprised of bisphenol A-epichlorohydrin hardenable resin present in an amount of about 45% by weight of the composition, a 4,4'-diaminodiphenylsulfone hardening agent present in an amount of about 40% by weight of the composition, a n-beta-(aminoethyl)-gamma-aminopropyltrimethoxy silane coupling agent present in an amount of about 1% by weight of the composition, a $C_{12}$–$C_{22}$ alkylphosphonate surfactant present in an amount of about 5% by weight of the composition, and a dipropylene glycol methyl ether organic carrier liquid present in an amount of about 9% by weight of the composition; combining the hardenable resin composition coated gravel produced in step (b) with an aqueous carrier liquid comprised of fresh water or salt water; pumping the aqueous carrier liquid containing the hardenable resin composition coated gravel into the well bore between the producing zone therein and the tool to place the hardenable resin composition gravel therein; and allowing the hardenable resin composition on the coated gravel to harden and consolidate the gravel into a high strength permeable gravel pack which prevents the loss of gravel with produced fluids.

Another method is as follows. In a method of forming a through-tubing vent-screen tool completion in a well bore which includes the steps of placing the tool in the well bore adjacent to a producing zone therein and then placing gravel in the well bore to form a gravel pack between the producing zone and the tool without compressive forces being exerted on the gravel pack, the improvement which prevents the loss of gravel from the gravel pack with fluids produced from the producing zone which comprises: (a) prior to placing the gravel in the well bore, coating the gravel with a hardenable resin composition comprised of a hardenable resin, a hardening agent for causing the hardenable resin to harden, a silane coupling agent, a surfactant for facilitating the coating of the hardenable resin composition on the gravel and for causing the hardenable resin composition to flow to the contact points between adjacent resin coated gravel particles, and an organic carrier liquid having a flash point above about 125° F.; (b) combining the hardenable resin composition coated gravel produced in step (a) with an aqueous carrier liquid; (c) pumping the aqueous carrier liquid containing the hardenable resin composition coated gravel into the well bore between the producing zone therein and the tool to place the hardenable resin composition coated gravel therein; and (d) allowing the hardenable resin composition on the coated gravel to harden and consolidate the gravel into a high strength permeable gravel pack which prevents the loss of gravel with produced fluids.

In order to further illustrate the methods of the present invention, the following example is given.

A hardenable resin mixture was prepared by mixing 4.6 mL of bisphenol A-epichlorohydrin hardenable resin with 3.7 mL of 4,4'diaminodiphenyl hardening agent, 0.2 mL of n-beta-(aminoethyl)-gamma-aminopropyltrimethoxysilane coupling agent, 0.5 mL of $C_{12}$–$C_{22}$ alkyl phosphonate surfactant, and 1.0 mL of dipropylene glycol methyl ether as organic carrier. After mixing these components well, 7.5 mL of the mixture was withdrawn and added to 250 grams of proppant. The proppant and the resin were stirred with an overhead stirrer at low speed to allow the resin to evenly coat onto the proppant. The coated proppant was added to a stirred beaker containing 300 mL of a gelled hydroxyethylcellulose carrier fluid and the contents of the beaker were heated in a water bath to 125° F. The stirring was continued for 30 minutes to simulate pumping time. The proppant slurry was then packed into a 1.38-inch ID brass chamber and placed in an oven and cured at a designed temperature and cure time without applying closure stress. After being cured, the consolidated cores were removed from the brass chamber for unconfined compressive strength (UCS) measurements. The results of these tests are given in the Table below.

TABLE

Unconsolidated Compressive Strengths After Curing for 24 Hours

| Proppant | Cure Temperature | UCS (psi) |
|---|---|---|
| 20/40 Brady Sand | 140° F. | 570 |
| 20/40 Intermediate Strength Bauxite | 140° F. | 500 |
| 20/40 Brady Sand | 165° F. | 730 |
| 20/40 Intermediate Strength Bauxite | 165° F. | 670 |

Thus, the present invention is well adapted to attain the objects and advantages mentioned as well as those which are inherent therein. While numerous changes may be made by those skilled in the art, such changes are encompassed within the spirit of this invention as defined by the appended claims.

What is claimed is:

1. In a method of forming a through-tubing vent-screen tool completion in a well bore which includes the steps of placing the tool in the well bore adjacent to a producing zone therein and then placing gravel in the well bore to form a gravel pack between the producing zone and the tool without compressive forces being exerted on the gravel pack, the improvement which prevents the loss of gravel from the gravel pack with fluids produced from the producing zone which comprises:

(a) prior to placing said gravel in said well bore, coating said gravel with a hardenable resin composition comprised of a hardenable resin, a hardening agent for causing the hardenable resin to harden, a silane coupling agent, a surfactant for facilitating the coating of said hardenable resin composition on said gravel and for causing said hardenable resin composition to flow to the contact points between adjacent resin coated gravel particles, and an organic carrier liquid having a flash point above about 125° F.;

(b) combining said hardenable resin composition coated gravel produced in step (a) with an aqueous carrier liquid;

(c) pumping said aqueous carrier liquid containing said hardenable resin composition coated gravel into said well bore between said producing zone therein and said tool to place said hardenable resin composition coated gravel therein; and (d) allowing said hardenable resin composition on said coated gravel to harden and consolidate said gravel into a high strength permeable gravel pack which prevents the loss of gravel with produced fluids.

2. The method of claim 1 wherein said hardenable resin in said hardenable resin composition is an organic resin comprising at least one member selected from the group consisting of bisphenol A-epichlorohydrin resin, polyepoxide resin, novolak resin, polyester resin, phenol-aldehyde resin, urea-aldehyde resin, furan resin, urethane resin, glycidyl ether and mixtures thereof.

3. The method of claim 1 wherein said hardenable resin in said hardenable resin composition is comprised of bisphenol A-epichlorohydrin resin.

4. The method of claim 1 wherein said hardenable resin in said hardenable resin composition is present in an amount in the range of from about 35% to about 60% by weight of said composition.

5. The method of claim 1 wherein said hardening agent in said hardenable resin composition comprises at least one member selected from the group consisting of amines, aromatic amines, polyamines, aliphatic amines, cyclo-aliphatic amines, amides, polyamides, 4,4'-diaminodiphenyl sulfone, 2-ethyl-4-methyl imidazole and 1,1,3-trichlorotrifluoroacetone.

6. The method of claim 1 wherein said hardening agent in said hardenable resin composition is comprised of 4,4'-diaminodiphenyl sulfone.

7. The method of claim 1 wherein said hardening agent in said hardenable resin composition is present in an amount in the range of from about 35% to about 50% by weight of said composition.

8. The method of claim 1 wherein said silane coupling agent in said hardenable resin composition comprises at least one member selected from the group consisting of N-2-(aminoethyl)-3-aminopropyltrimethoxysilane, 3-glycidoxypropyltrimethoxysilane and n-beta-(aminoethyl)-gamma-aminopropyltrimethoxysilane.

9. The method of claim 1 wherein said silane coupling agent in said hardenable resin composition is comprised of n-beta-(aminoethyl)-gamma-aminopropyltrimethoxysilane.

10. The method of claim 1 wherein said silane coupling agent in said hardenable resin composition is present in an amount in the range of from about 0.1% to about 5% by weight of said composition.

11. The method of claim 1 wherein said surfactant in said hardenable resin composition comprises at least one member selected from the group consisting of an ethoxylated nonyl phenol phosphate ester, mixtures of one or more cationic surfactants and one or more non-ionic surfactants and a $C_{12}$–$C_{22}$ alkyl phosphonate surfactant.

12. The method of claim 1 wherein said surfactant in said hardenable resin composition is comprised of a $C_{12}$–$C_{22}$ alkyl phosphonate surfactant.

13. The method of claim 1 wherein said surfactant in said hardenable resin composition is present in an amount in the range of from about 0.1% to about 10% by weight of said composition.

14. The method of claim 1 wherein said organic carrier liquid having a flash point above about 125° F. in said hardenable resin composition comprises at least one member selected from the group consisting of dipropylene glycol methyl ether, dipropylene glycol dimethyl ether, dimethyl formamide, diethyleneglycol methyl ether, ethyleneglycol butyl ether, diethyleneglycol butyl ether, propylene carbonate, d'limonene and fatty acid methyl esters.

15. The method of claim 1 wherein said organic carrier liquid in said hardenable resin composition is comprised of dipropylene glycol methyl ether.

16. The method of claim 1 wherein said organic carrier liquid in said hardenable resin composition is present in an amount up to about 20% by weight of said composition.

17. The method of claim 1 wherein said aqueous carrier liquid is comprised of fresh water or salt water.

18. A method of forming a through-tubing vent-screen tool completion in a well bore adjacent to a producing zone comprising the steps of:

(a) placing said through-tubing vent-screen tool in said well bore adjacent to said producing zone therein;

(b) coating gravel to be placed in said well bore with a hardenable resin composition comprised of a hardenable resin, a hardening agent for causing the hardenable resin to harden, a silane coupling agent, a surfactant for facilitating the coating of said hardenable resin composition on said gravel and for causing said hardenable resin composition to flow to the contact points between adjacent resin coated gravel particles, and an organic carrier liquid having a flash point above about 125° F.;

(c) combining said hardenable resin composition coated gravel produced in step (b) with an aqueous carrier liquid;

(d) pumping said aqueous carrier liquid containing said hardenable resin composition coated gravel into said well bore between said producing zone therein and said tool to place said hardenable resin composition gravel therein; and (e) allowing said hardenable resin composition on said coated gravel to harden and consolidate said gravel into a high strength permeable gravel pack which prevents the loss of gravel with produced fluids.

19. The method of claim 18 wherein said hardenable resin in said hardenable resin composition is an organic resin comprising at least one member selected from the group consisting of bisphenol A-epichlorohydrin resin, polyepoxide resin, novolak resin, polyester resin, phenol-aldehyde resin, urea-aldehyde resin, furan resin, urethane resin, glycidyl ether and mixtures thereof.

20. The method of claim 18 wherein said hardenable resin in said hardenable resin composition is comprised of bisphenol A-epichlorohydrin resin.

21. The method of claim 18 wherein said hardenable resin in said hardenable resin composition is present in an amount in the range of from about 35% to about 60% by weight of said composition.

22. The method of claim 18 wherein said hardening agent in said hardenable resin composition comprises at least one member selected from the group consisting of amines, aromatic amines, polyamines, aliphatic amines, cycloaliphatic amines, amides, polyamides, 4,4'-diaminodiphenyl sulfone, 2-ethyl-4-methyl imidazole and 1,1,3-trichlorotrifluoroacetone.

23. The method of claim 18 wherein said hardening agent in said hardenable resin composition is comprised of 4,4'-diaminodiphenyl sulfone.

24. The method of claim 18 wherein said hardening agent in said hardenable resin composition is present in an amount in the range of from about 35% to about 50% by weight of said composition.

25. The method of claim 18 wherein said silane coupling agent in said hardenable resin composition comprises at least one member selected from the group consisting of N-2-(aminoethyl)-3-aminopropyltrimethoxysilane, 3-glycidoxypropyltrimethoxysilane and n-beta-aminoethyl)-gamma-aminopropyltrimethoxysilane.

26. The method of claim 18 wherein said silane coupling agent in said hardenable resin composition is comprised of n-beta-(aminoethyl)-gamma-aminopropyltrimethoxysilane.

27. The method of claim 18 wherein said silane coupling agent in said hardenable resin composition is present in an amount in the range of from about 0.1% to about 5% by weight of said composition.

28. The method of claim 18 wherein said surfactant in said hardenable resin composition comprises at least one member selected from the group consisting of an ethoxylated nonyl phenol phosphate ester, mixtures of one or more cationic surfactants and one or more non-ionic surfactants and a $C_{12}$–$C_{22}$ alkyl phosphonate surfactant.

29. The method of claim 18 wherein said surfactant in said hardenable resin composition is comprised of a $C_{12}$–$C_{22}$ alkyl phosphonate surfactant.

30. The method of claim 18 wherein said surfactant in said hardenable resin composition is present in an amount in the range of from about 0.1% to about 10% by weight of said composition.

31. The method of claim 18 wherein said organic carrier liquid having a flash point above about 125° F. in said hardenable resin composition comprises at least one member selected from the group consisting of dipropylene glycol methyl ether, dipropylene glycol dimethyl ether, dimethyl formamide, diethyleneglycol methyl ether, ethyleneglycol butyl ether, diethyleneglycol butyl ether, propylene carbonate, d'limonene and fatty acid methyl esters.

32. The method of claim 18 wherein said organic carrier liquid in said hardenable resin composition is comprised of dipropylene glycol methyl ether.

33. The method of claim 18 wherein said organic carrier liquid in said hardenable resin composition is present in an amount up to about 20% by weight of said composition.

34. The method of claim 18 wherein said aqueous carrier liquid is comprised of fresh water or salt water.

* * * * *